US005562216A

United States Patent [19]

Falconio

[11] Patent Number: 5,562,216

[45] Date of Patent: Oct. 8, 1996

[54] CIRCULAR RACK FOR CAPS

[76] Inventor: Pasquale P. Falconio, 6384 Camden Ave., San Jose, Calif. 95120

[21] Appl. No.: 428,861

[22] Filed: Apr. 25, 1995

[51] Int. Cl.[6] ..... A47F 5/00

[52] U.S. Cl. ..... 211/33; 211/131; 211/163

[58] Field of Search ..... 211/163, 144, 211/131, 30, 33, 181; 248/176.1

[56] References Cited

U.S. PATENT DOCUMENTS

| | | | |
|---|---|---|---|
| 2,071,290 | 2/1937 | Scriba | 211/131 X |
| 2,213,677 | 9/1940 | Miller | 211/30 |
| 3,331,515 | 7/1967 | Lange | 211/131 X |
| 3,417,873 | 12/1968 | Leptrone | 211/131 X |
| 3,452,880 | 7/1969 | Kovacik et al. | 211/131 X |
| 3,847,285 | 11/1974 | Leprince | 211/163 X |
| 3,995,744 | 12/1976 | Metcalf | 211/131 |
| 4,036,367 | 7/1977 | Stambaugh et al. | 211/163 X |
| 4,289,246 | 9/1981 | Scott | 211/131 X |
| 5,277,488 | 1/1994 | Cleary et al. | 211/144 X |
| 5,480,036 | 1/1996 | Opar | 211/163 X |

*Primary Examiner*—Robert W. Gibson, Jr.
*Attorney, Agent, or Firm*—Keith Kline

[57] ABSTRACT

A circular rack for caps. The rack comprises multiple rotatable cap fixtures. The fixtures each hold a plurality of caps for storage and/or display. The fixtures rotate about a central support pole. The fixtures may be adapted so that a double layer of caps can be held, that is, a first layer of caps oriented right side up, and a second layer of caps oriented upside down. In addition, a lamp or a decorative item, such as a sports trophy or a piece of sporting equipment, may be affixed at the top of the central support pole.

6 Claims, 3 Drawing Sheets

CIRCULAR RACK FOR CAPS

FIELD OF THE INVENTION

The present invention relates generally to hat racks, and more particularly is a circular stand for the display of caps.

BACKGROUND OF THE INVENTION

Hat racks in one form or another have been available to hold hats for many many years. With the recent popularity of collecting baseball style caps, more attention has been given to methods of display for these billed caps.

Traditionally, caps are hung in a row, or rows, on a peg board or the like. This style of display has the shortcoming of requiring a large amount of space as one's cap collection grows. The prior art lacks an efficient method of displaying a large number of caps in as little space as possible.

OBJECTS, SUMMARY, AND ADVANTAGES OF THE INVENTION

Accordingly, it is an object of the present invention to provide a means to display a collection of caps.

It is a further object of the present invention to provide a device that allows a large number of caps to be displayed while utilizing a small amount of floor space.

In summary, the present invention is a circular rack for caps. The rack comprises multiple rotatable cap fixtures. The fixtures each hold a plurality of caps for storage and/or display. The fixtures rotate about a central support pole. The fixtures may be adapted so that a double layer of caps can be held, that is, a first layer of caps oriented right side up, and a second layer of caps oriented upside down. In addition, a lamp or a decorative item, such as a sports trophy or a piece of sporting equipment, may be affixed at the top of the central support pole.

An advantage of the present invention is that it allows a user to display a large number of caps while using a minimal amount of floor space.

A further advantage of the present invention is that it is simple and inexpensive to manufacture.

These and other objects and advantages of the present invention will become apparent to those skilled in the art in view of the description of the best presently known mode of carrying out the invention as described herein and as illustrated in the drawings.

BEST MODE OF CARRYING OUT THE INVENTION

Figure 1:
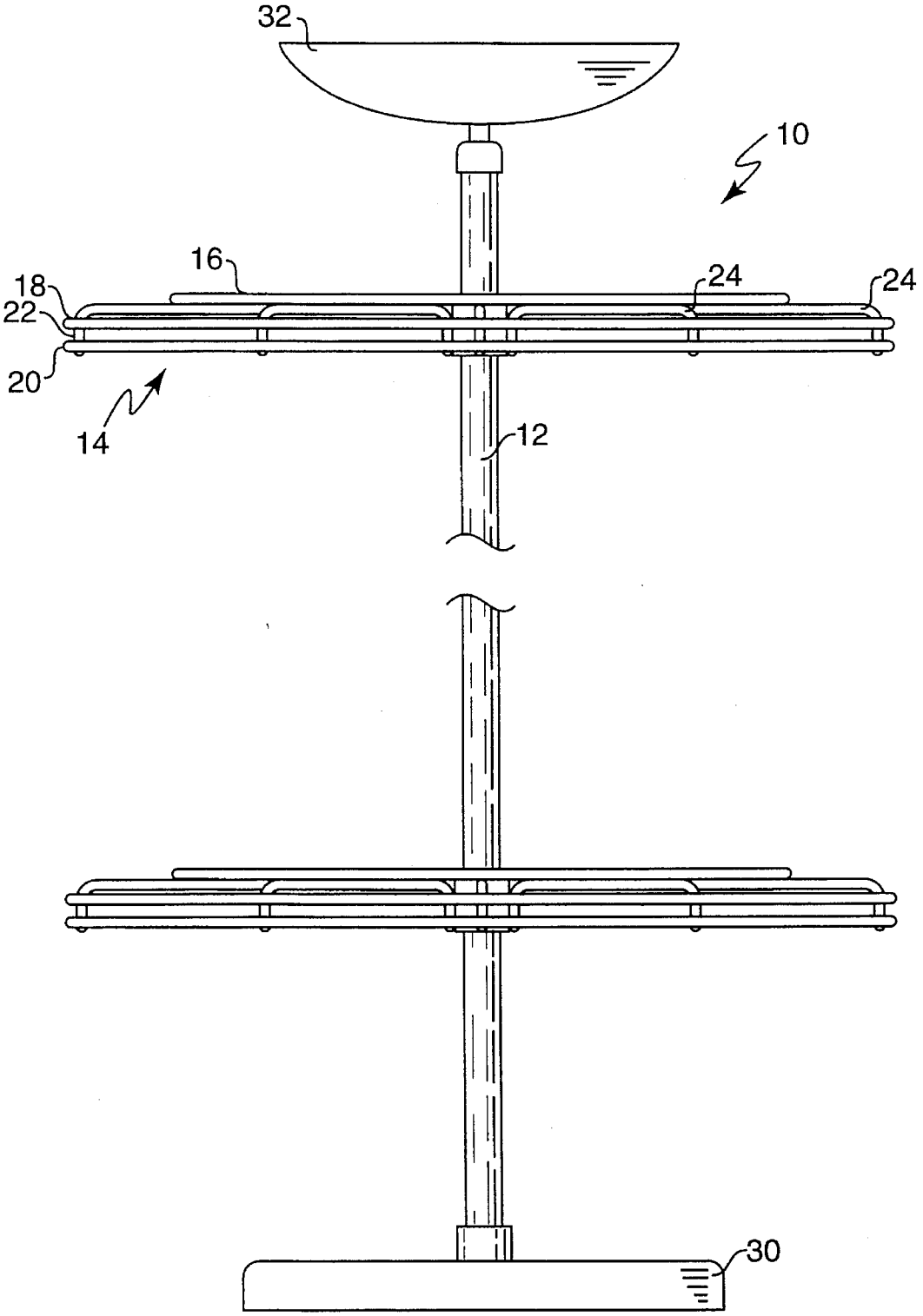
FIG. 1 is a broken perspective view of the cap rack of the present invention.
Figure 2:
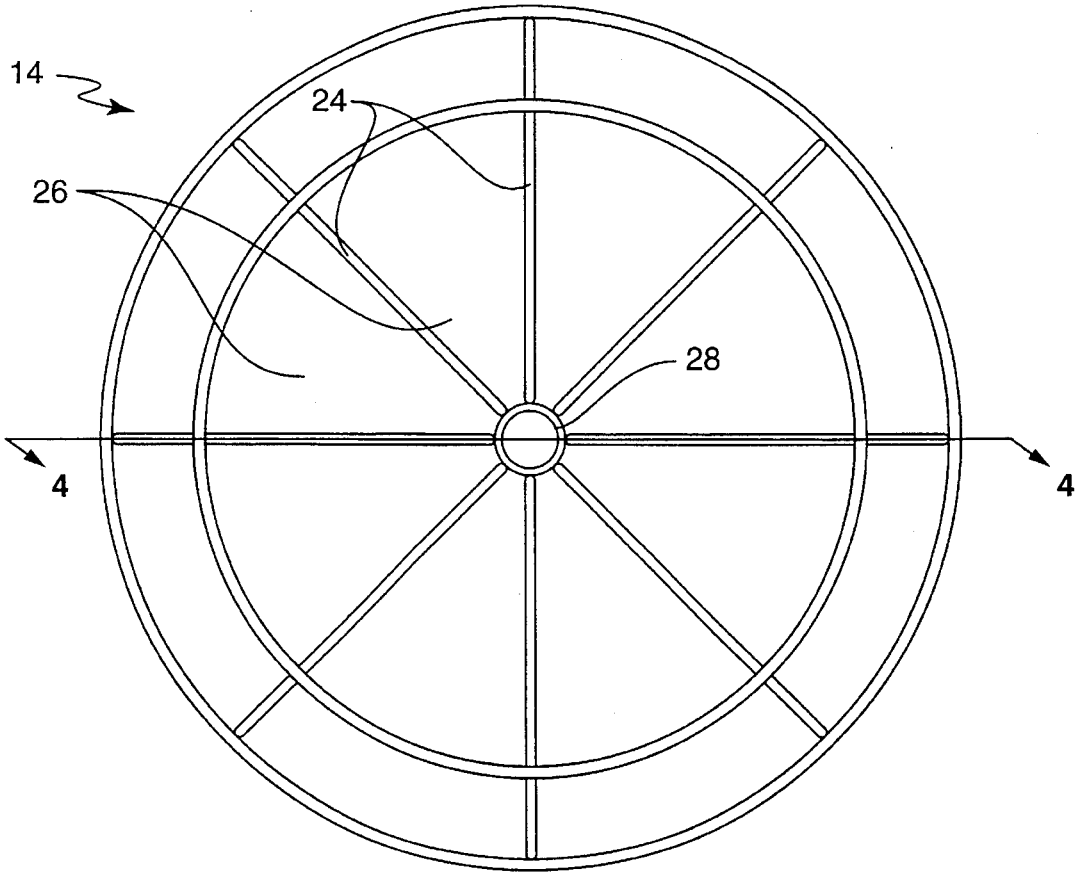
FIG. 2 is a top view of a display fixture of the cap rack of the present invention.
Figure 3:
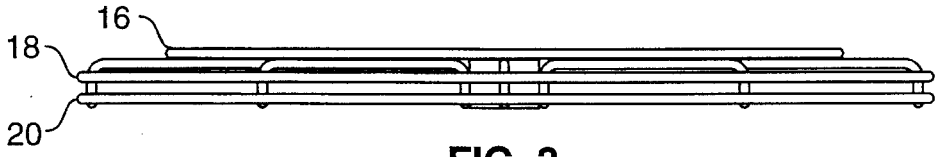
FIG. 3 is a side view of a display fixture of the cap rack of the present invention.
Figure 4:
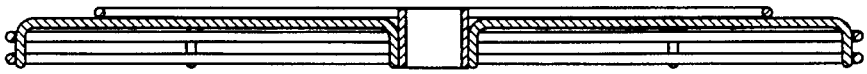
FIG. 4 is a cross sectional view of the fixture taken along line 4—4 in FIG. 2.

The present invention is a rack 10 for the display and storage of baseball caps. The rack 10 comprises a central support pole 12 and at least one circular, rotatable fixture 14 that holds the caps.

The fixture 14 includes three rings—a first ring 16, a second ring 18, and a third ring 20. The first ring 16 lies on an upper side of the fixture 14, between the central support pole 12 and the perimeter of the fixture 14. The first ring functions as a support element for the rear portion of the cap.

The second and third rings 18, 20 lie on the perimeter of the fixture 14. A gap 22 between the second and third rings 18, 20 receives the bills of the caps to be displayed. The gap 22 is of sufficient width so that the bills of two caps can be inserted into the gap 22, if caps are to be displayed both right side up and upside down. (Utilizing this option allows double density for the cap display.) The rear portion of the caps placed upside down would of course not be supported, but the inventor has discovered that most caps are sufficiently stiff to remain in position when supported only by the bill.

Dividing rods 24 serve as a chassis for the fixture 14 and also to define display compartments 26 for the individual caps. The dividing rods 24 are affixed to and extend outward from a central hub 28. The hubs 28 of the fixtures 14 are held in their vertical positions on the support poles 12 by means of recesses in the support pole 12 or protrusions extending from the support pole 12. The hubs 28 are rotatably affixed to the pole 12 so that the fixtures 14 are able to rotate to display the caps contained therein.

A base 30 at a lower end of the support pole 12 holds the cap rack 10 in an upright position. The support pole may include various attachments affixed at an upper end. In one embodiment, the support pole is hollow to contain electrical wiring, and a lamp 32 is affixed to an upper end of the support pole 12. The inventor envisions that users may want to utilize various sporting figures, as on trophies, as the attachments on the top of the support pole 12.

Figure 5:
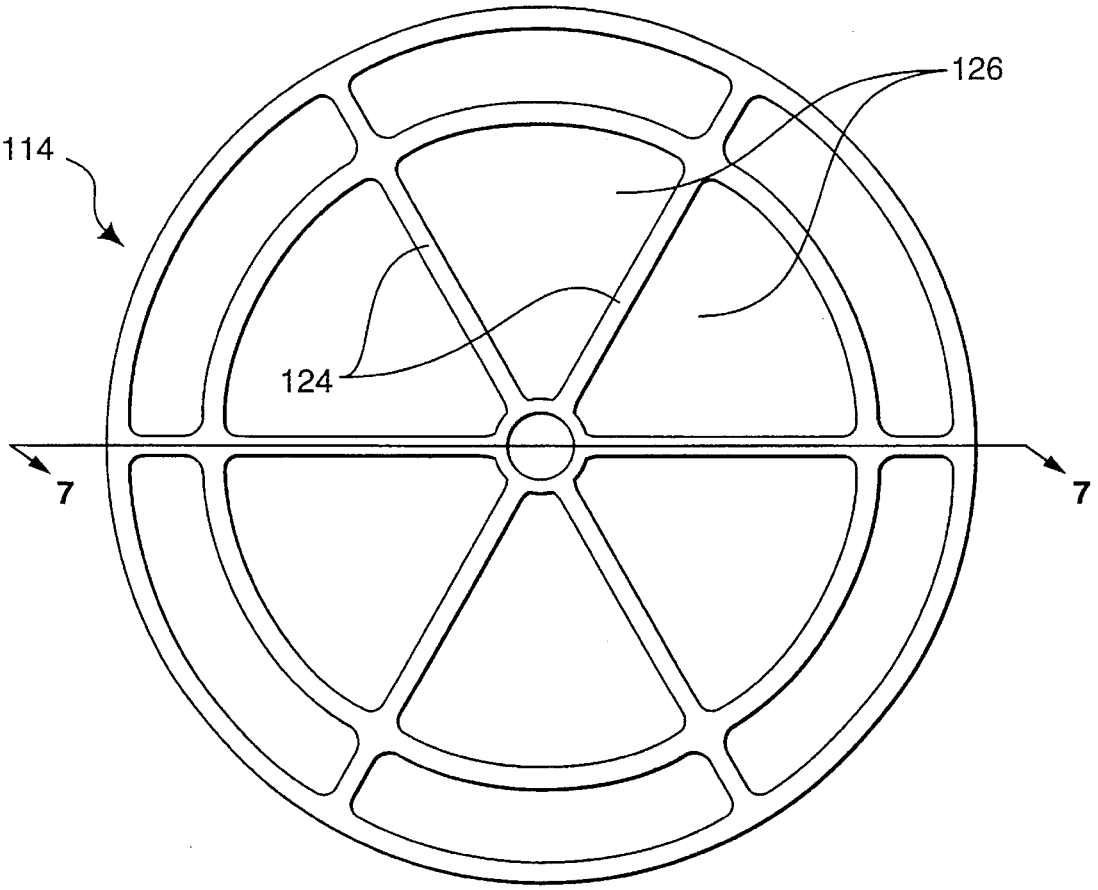
FIG. 5 is a top view of an alternate embodiment of the fixture of the cap rack.
Figure 6:
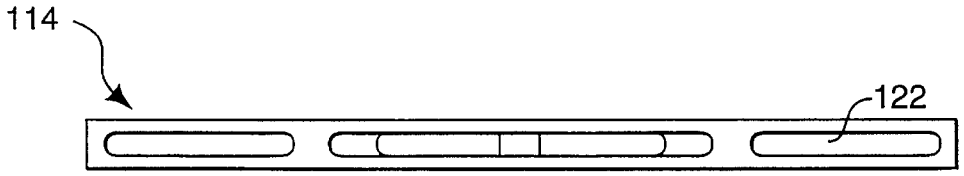
FIG. 6 is a side view of the embodiment of the fixture shown in FIG. 5.
Figure 7:
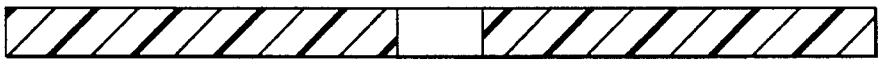
FIG. 7 is a cross sectional view taken along line 7—7 in FIG. 5.

An alternate construction of the fixtures is illustrated in FIGS. 5–7. The alternate fixture 114 is made from molded plastic instead of the wire rods utilized for the rings and dividing rods of the primary embodiment. The alternate embodiment 114 is therefore a single piece of material. Dividing rods 124 still separate the fixture 114 into compartments 126, and a gap 122 still receives the bills of the caps.

It is envisioned by the inventor that the number of cap display compartments utilized in the rack of the present invention will be either 6 or 8. Experimentation by the inventor has shown that the practical limitation of the number of fixtures to allow reasonable display is six.

The above disclosure is not intended as limiting. Those skilled in the art will readily observe that numerous modifications and alterations of the device may be made while retaining the teachings of the invention. Accordingly, the above disclosure should be construed as limited only by the metes and bounds of the appended claims.

I claim:

1. A rack for caps comprising:

at least one fixture adapted to contain said caps, a central support pole including means to affix said fixture in a vertical position desired by a user, and a base to support said rack; wherein said fixture includes a first ring, a second ring, and a third ring, said first ring being located on said fixture on an upper side between said central support pole and a perimeter of said fixture, said second ring being affixed to said perimeter of said fixture, and said third ring being affixed to said perimeter of said fixture at a distance below said second ring such that a gap is formed, said gap being adapted to receive a bill of said caps, said caps thereby being supported by said first ring, said fixture further including a plurality of dividing rods which define compartments, inner ends of said dividing rods are affixed to a rotatable hub which encircles the central support pole, and outer ends of said dividing rods define a perimeter of said fixture.

2. The cap rack of claim 1 wherein:

said fixture is molded as a unitary piece of material.

3. The cap rack of claim 1 wherein:

a lamp is affixed to an upper end of said central support pole.

4. The cap rack of claim 1 wherein:

a sports figurine is affixed to an upper end of said central support pole.

5. The cap rack of claim 2 wherein:

a lamp is affixed to an upper end of said central support pole.

6. The cap rack of claim 2 wherein:

a sports figurine is affixed to an upper end of said central support pole.

* * * * *